US006805641B2

(12) United States Patent
Pope

(10) Patent No.: US 6,805,641 B2
(45) Date of Patent: Oct. 19, 2004

(54) GOLF SWING TRAINING APPARATUS, AND METHOD OF USING SAME

(76) Inventor: Shawn P. Pope, P.O. Box 2224, Rolla, MO (US) 65402

( * ) Notice: Subject to any disclaimer, the term of this patent is extended or adjusted under 35 U.S.C. 154(b) by 0 days.

(21) Appl. No.: 09/969,236

(22) Filed: Oct. 2, 2001

(65) Prior Publication Data

US 2003/0064821 A1 Apr. 3, 2003

(51) Int. Cl.[7] ..... A63B 69/36
(52) U.S. Cl. ..... 473/274
(58) Field of Search ..... 473/257, 274, 473/208, 207, 215, 268, 266, 273, 275, 276, 277

(56) References Cited

U.S. PATENT DOCUMENTS 1,636,753 A * 7/1927 Olcott
2,252,831 A * 8/1941 Botts
2,611,610 A * 9/1952 Hara
2,690,911 A * 10/1954 Newgren
3,104,880 A * 9/1963 Profera
3,138,388 A * 6/1964 Herold
3,510,135 A * 5/1970 Gentile
3,698,721 A * 10/1972 Stewart
3,770,280 A 11/1973 Straus
4,302,014 A 11/1981 Shull
4,513,972 A 4/1985 Empie
4,758,000 A * 7/1988 Cox
4,998,731 A * 3/1991 Bowen
5,586,761 A * 12/1996 Brock et al.
5,634,858 A 6/1997 Bellagamba

* cited by examiner

*Primary Examiner*—Stephen P. Garbe
*Assistant Examiner*—Nini F. Legesse
(74) *Attorney, Agent, or Firm*—Carrier, Blackman & Associates, P.C.; William D. Blackman; Joseph P. Carrier

(57) ABSTRACT

A golf swing training apparatus, for creating proper head-to-body alignment, assists a user thereof in acquiring muscle memory of a correct golf swing, while remaining substantially out of the user's field of vision. The training apparatus provides a support section and an engagement arm movably connected to the support section. The engagement arm terminates at an adjustably positionable pad, provided for comfortable contact with a dorsal surface of the user's neck during the process of swinging a golf club. The apparatus provides for accurate feedback of the correctness of the user's swing, while affording the user the freedom of movement, substantially without restriction.

21 Claims, 7 Drawing Sheets

GOLF SWING TRAINING APPARATUS, AND METHOD OF USING SAME

BACKGROUND OF THE INVENTION

1. Field of the Invention

The present invention relates to a training aid or apparatus for use in improving a golf swing, and to a method of using the apparatus. More particularly, the present invention relates to a training tool for improving a golfer's swing by monitoring the user's head-to-body alignment throughout a golf swing.

2. Description of the Background Art

Training tools of many different types are widely used in the sport of golf. In particular, golf-training tools often focus on alignment of the head, in relation to the body, during the golf swing. Several variants of golf training tools focusing on head movement are illustrated in U.S. Pat. Nos. 3,770,280; 4,302,014; and, 4,513,972.

U.S. Pat. No. 3,770,280, issued to Straus, and entitled, "Golf Training and Practice Device," discloses a device which controls a user's head movement through use of an adjustable headband, which fits about a user's head, and which is electro-magnetically attached to an adjustable outwardly extending arm of the device. The adjustable outwardly extending arm of the Straus device is pivotally mounted to a pole extending upwardly from the platform portion of the device. Operation of the Strauss device is such that the components of the device are facing the user during operation.

U.S. Pat. No. 4,302,014, issued to Shull, and entitled, "Golf Training Device," discloses a device that controls head movement of a user, by means of the user wearing an adjustable headband which is rotatably mounted to an outwardly extending tube. This outwardly extending tube is pivotally mounted to the device's telescopically adjustable anchoring pole. Operation of the Shull invention is such that the components of the invention face the user during operation.

U.S. Pat. No. 4,513,972, issued to Empie, and entitled, "Golfer's Head Movement Restraining Device," employs a helmet-style apparatus, with an adjustable chinstrap, to control the user's head movement. The helmet-style apparatus, as worn by the user, is rotatably mounted to an outwardly extending tube and pivotally attached to a telescopically adjustable anchoring pole. Operation of the Empie invention is such that the components of the invention face the user during operation.

In response to the common problem of head movement during a golf swing, the above referenced inventions offer devices for improving/creating muscle memory of proper head-to-body alignment during a golf swing. However, these devices have some limitations and disadvantages associated therewith. For example, the necessity for a portion of the device to be secured to the user's head is uncomfortable and unduly restricting to natural motions. Further, no single one of the devices offers a golfer the ability to readily utilize the invention on virtually any surface, either indoors or out of doors. Still further, each of the aforementioned inventions remains prominently within the user's field of vision during operation, and thus is a significant distraction.

As a result, a need still exists in the art for a simple and inexpensive apparatus that effectively monitors the user's head-to-body alignment during a golf swing, without being physically attached to the golfer, that minimally restricts the golfer's natural motions, and that is capable of use on any flat surface. Ideally, such a training apparatus could be adapted to remain out of the user's field of vision during use. In particular, there is a need for an adjustable and collapsible golf swing aid which permits a user to easily practice the control-alignment of his/her head and body throughout an entire golf swing, and to create muscle memory of correct head-to-body alignment for a proper golf swing, and yet which is minimally restrictive to a golfer's natural motions.

SUMMARY OF THE INVENTION

The present invention has been developed to overcome the foregoing limitations and disadvantages of known golf swing improvement tools, and to generally fulfill the discussed needs in the art.

A golf swing training apparatus, in accordance with the present invention, includes a support section that supports the apparatus on a substrate, and an adjustable arm, outwardly extending from an upper end of the support section. The adjustable arm includes an engagement member at a free end thereof, for contacting a dorsal surface of a user.

Accordingly, it is an object of the present invention to provide a golf swing training apparatus for contacting a dorsal surface of a user, to provide the user with an unobstructed field of vision during operation. As a result of the dorsal placement of the apparatus, the apparatus is substantially invisible to the user. Therefore, the user is not obstructed, hindered, or distracted by any portion of the apparatus while swinging a golf club, affording the user a more natural or unassisted feeling, for increased muscle memory over a shorter period of time.

Another object of the present invention is to provide an engagement member, which affords the user accurate feedback as to the correctness of a swing, without confining the user directly to the invention, or requiring the user to wear some part of the invention. Through the provision of a small pad, for continually contacting with a lower back portion of the user's neck during operation, the user is made aware of an improper golf swing if his/her neck is no longer in contact with the apparatus. Additionally, this manner of engagement offers the user freedom to function independently of the invention when desired, and to return to receiving the assistance of the invention when convenient.

Still another object of the present invention is to provide an apparatus which is highly adjustable, to be adaptable for use by users of varying height and/or golf stance styles. The invention fully adjusts through manipulation of the adjustment connectors and the micro-adjustable engagement member, to accommodate different users. Additionally, the present invention may be adjusted to enable the user to practice his/her swing with all club types (e.g. driver, iron, or putter).

Yet another object of the present invention is to provide a golf swing apparatus capable of being folded for convenient storage or transporting. The adjustable engagement arm may be folded downwardly to the support section, to reduce storage space and to enable the apparatus to be easily transported.

Moreover, it is another object of the present invention to provide a golf swing training apparatus which may be used on virtually any flat surface, either indoors or out-of-doors. The elongate hollow base with cross member enables the invention to be used on any substantially flat surface. The present invention affords the user the ability to reap the benefits of the device while indoors, out of doors at the driving range, on the putting green, in a sand bunker, or any other flat surface.

For a more complete understanding of the present invention, the reader is referred to the following detailed description, which should be read in conjunction with the accompanying drawings. Throughout the following detailed description and in the drawings, like numbers refer to like parts.

DETAILED DESCRIPTION OF THE PREFERRED EMBODIMENTS

Figure 1:
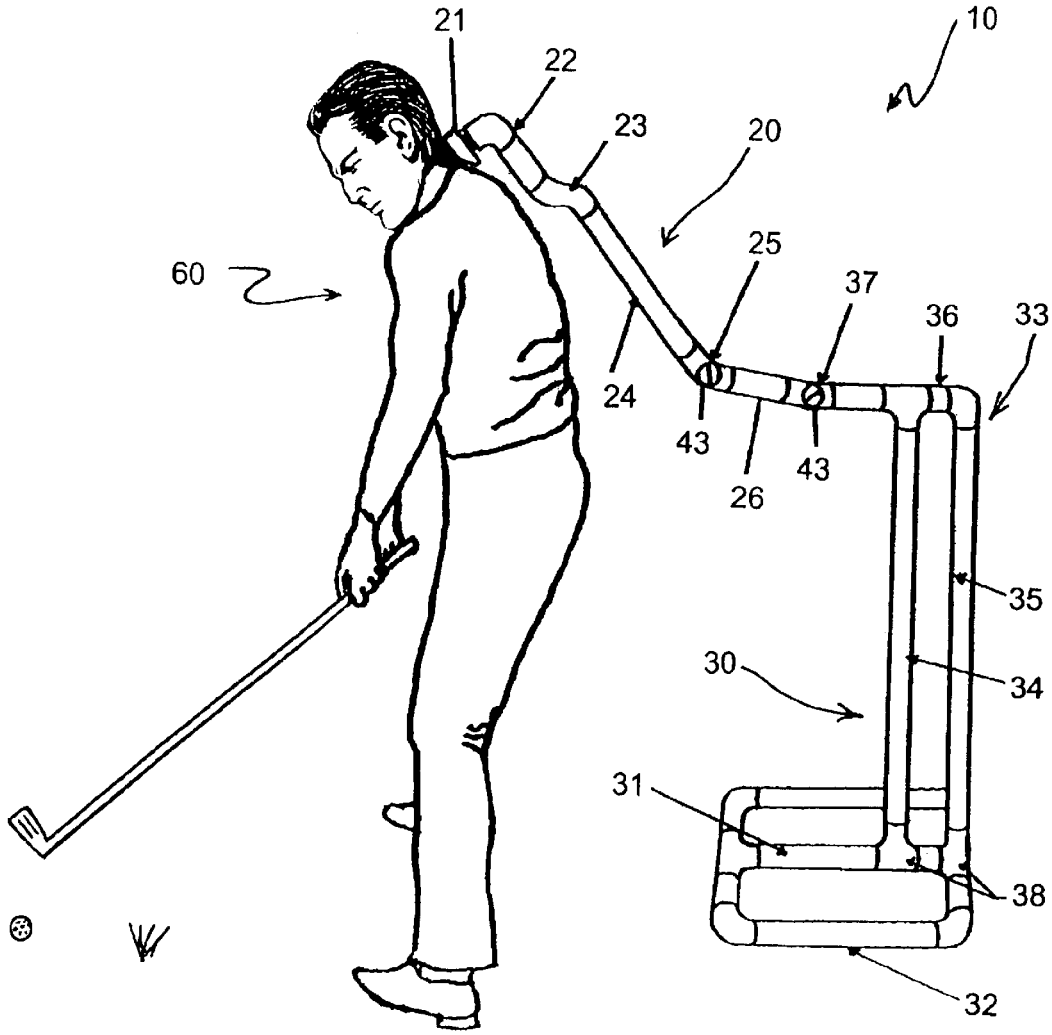
FIG. 1 is a side perspective view of a golf swing training apparatus in accordance with a first preferred embodiment of the invention, the aid being disposed in an operative position thereof, with a golfer also shown using the apparatus.
Figure 2:
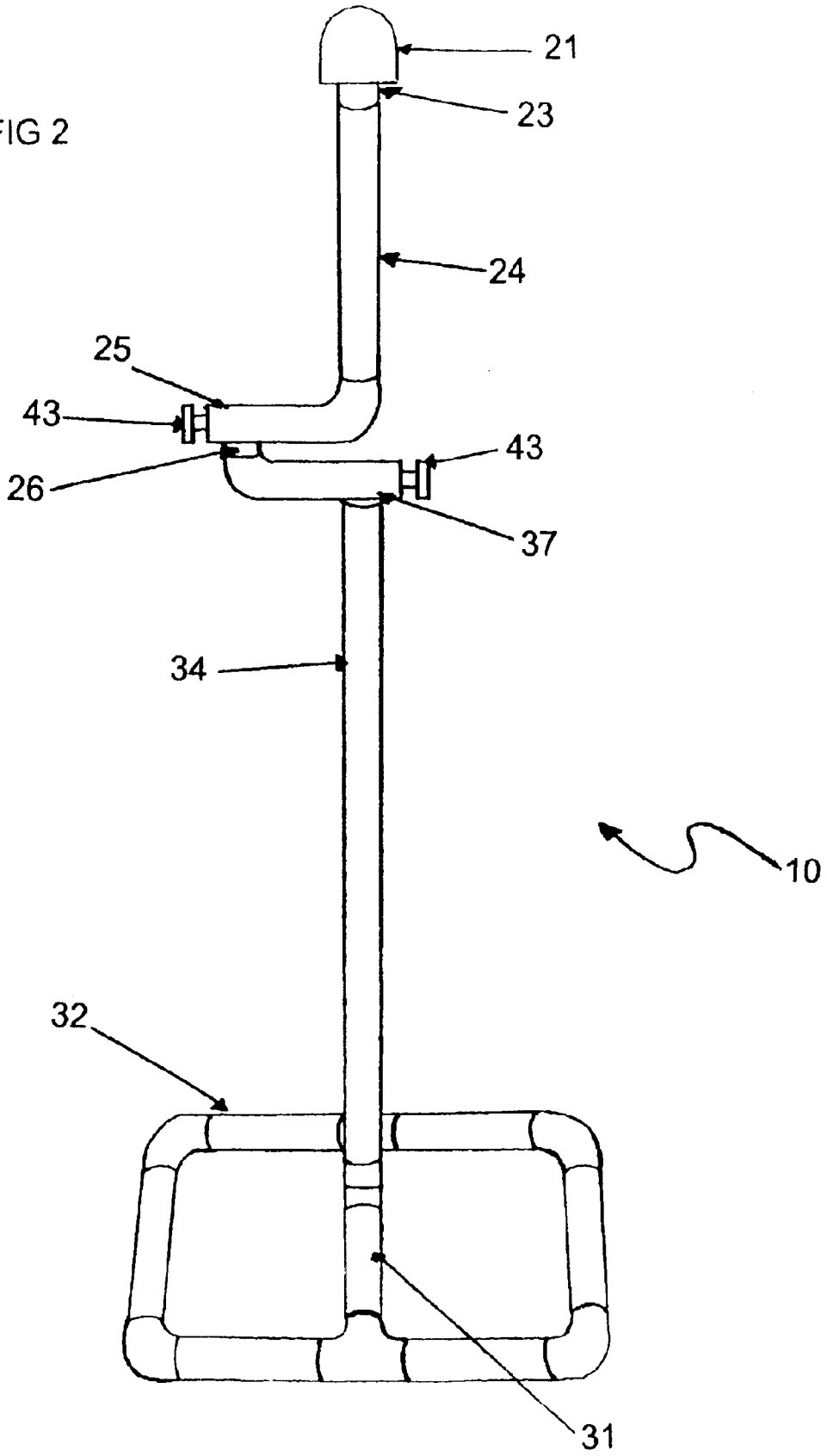
FIG. 2 is a front perspective view of the golf swing aid of FIG. 1.

Referring to FIGS. 1–6, a golf swing training apparatus, according to a first preferred embodiment of the present invention, is shown generally at 10. The apparatus 10 includes a support stand section 30, which rests on the ground or any other substantially flat surface, and an engagement arm section 20, which adjustably extends from the support section 30.

The engagement arm section 20 includes a free end having an engagement member 21 thereon, for operatively engaging a selected dorsal surface of a golfer 60 during use of the apparatus 10, as explained further below. The selected dorsal surface of the golfer 60 may be a portion of the golfer's neck, head or back.

Although the engagement member 21 may contact any dorsal surface of a golfer's body, for simplicity, the discussion below refers to its engagement with the nape or back of the golfer's neck, which is a preferred engagement surface according to the invention. It will be understood that without any structural changes, the apparatus as described herein may be adjusted to contact any part of a user's back, if the user prefers to use the apparatus in such fashion.

The Support Section

The support section 30 includes a base 32, for resting on the ground or other flat surface, and an upstanding portion 33 extending upwardly from the base 32. In the depicted embodiment, the upstanding portion 33 includes first and second vertically extending elongate stabilizing members 34 and 35, and an upper bridge member 36 connected to upper ends of the stabilizing members 34 and 35.

Alternatively, the support section 30 may optionally include only one or more than two upstanding stabilizing members.

As shown, the several components of the support section 30 are all preferably tubular in construction, and may be readily assembled together for use, or disassembled for storage and transportation. For example, the components may be constructed of mild steel or other metallic tubing having a diameter of 1"–3", with ends that are threaded (male-female) for being connected together. Alternatively, the components could be constructed of other appropriate materials such as PVC or other durable plastic tubing, could be permanently joined together through welding, adhesives, etc., and/or could be otherwise connectable together, e.g., with tapered or interference-fitting ends, that simply slide into engagement with each other. The overall height of the support section 30 will preferably be in a range of 3–4 feet.

The components of the apparatus 10 could also be made from appropriate metal or plastic bar stock, as an alternative to tubing.

The base 32 preferably has a wide, open shape, as shown, to provide sufficient stability for the apparatus 10 when the engagement arm section 20 is fully extended. As depicted, the base 32 includes a plurality of elongate members 31 arranged in parallel and connected at opposite ends thereof with elbows, T-fittings, and/or other engaging couplings 38 associated therewith. The engaging couplings 38 are also connected to lower ends of the first and second vertically extending elongate stabilizing members 34 and 35, respectively.

The stabilizing members 34, 35 are disposed at an end of the base 32 furthest away from the engagement member 21, to provide balance and stability.

The base 32 could have other configurations than that depicted, e.g., round, triangular, additional members 31, etc., as long as it provides sufficient support and stability for the balance of the apparatus 10. Optionally, securing stakes of appropriate shape and construction (not shown), could be provided for anchoring the base 32 to the ground for use when the apparatus is placed on grass, dirt or other material suitable for insertion of the stakes. Similarly, holes or appropriate brackets (not shown) could be provided on the base 32 to cooperate with auxiliary stakes to anchor it to the ground, where desired.

The Engagement Arm Section

In addition to the engagement member 21, the engagement arm section 20 includes upper and lower adjustable, releasably locking pivotal connecting devices 25 and 37, extension arm segments 24, 26, an engaging coupling 23, and a fore and aft adjustment assembly 22. The upper bridge member 36 of the support section 30 attaches to the lower adjustable connecting device 37, which connects to the shorter extension arm segment 26, which in turn, then attaches to the upper adjustable connecting device 25.

The upper adjustable connecting device 25 secures the second extension arm segment 24, engaging coupling 23, and the adjustment assembly 22 to the first extension arm segment 26.

The adjustment assembly 22 permits fore and aft movement of the engagement member 21 relative to the apparatus 10, through rotation of the engagement member 21 about a threaded connection 51 (FIG. 6), thereby changing the orientation and/or the projecting length of the engagement member 21 relative to the assembly 22. Other adjustment mechanisms known in the art, such as a telescopically sliding tube fixable with a thumbscrew, may be used.

The components 22–24 and 26 are also all preferably tubular in construction with materials, dimensions and characteristics such as discussed above in relation to the components of the support section 30. The components 22–24 and 26 may be readily assembled together for use, or disassembled for storage and transportation, together with the adjustable connecting devices 25 and 37, the engagement member 21 and the support section 30.

Figure 3:
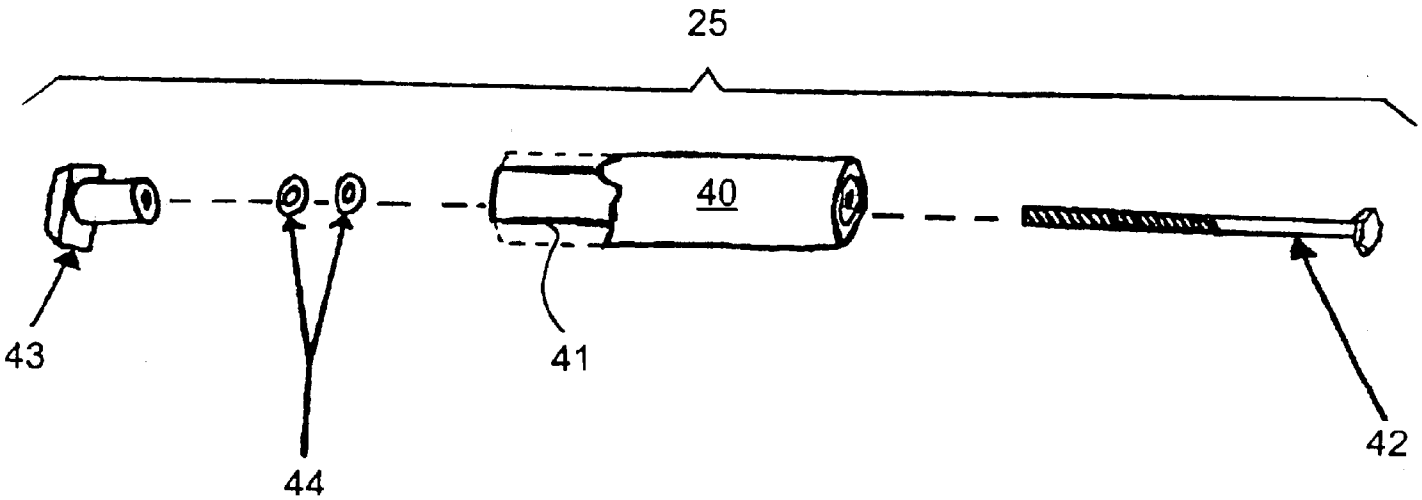
FIG. 3 is an exploded view showing a preferred construction of a pivotable, releasably locking connecting device of the golf swing apparatus of FIG. 1.
Figure 4:
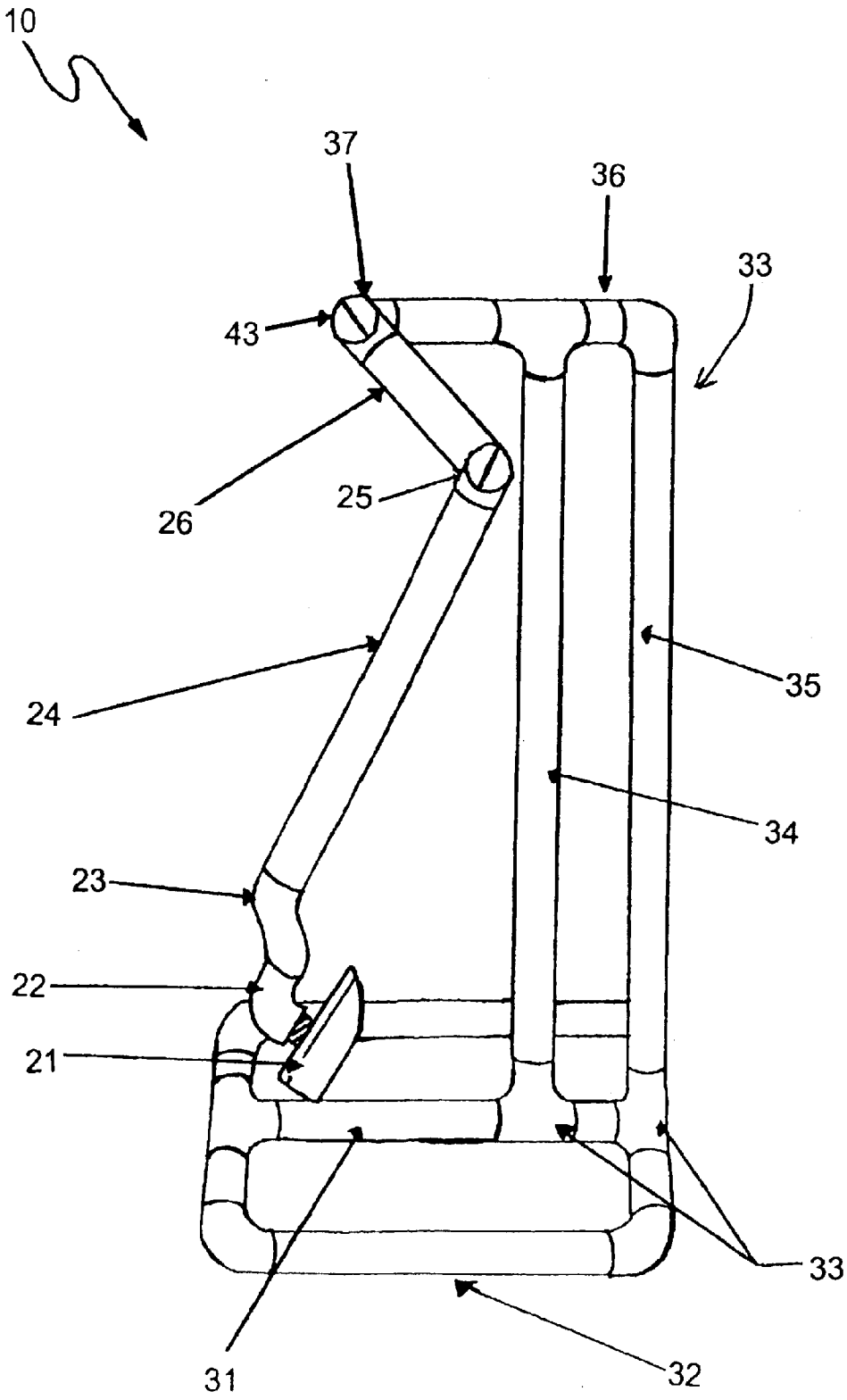
FIG. 4 is a side perspective view of the golf swing apparatus of FIG. 1 in a folded or collapsed position thereof.

The adjustable connecting devices 25 and 37 have a simple structure such as that shown in FIG. 3, which permits ready manual manipulation for adjusting the orientation of the engagement arm section 20 into various extended, operative positions corresponding to the size and preferences of the user, or into a collapsed storage/transportation position, as shown in FIG. 4. Overall, the engagement arm section 20 has a length similar to that of the support section 30 so that it can be folded adjacent the section 30 as shown in FIG. 4, but through adjustment of the apparatus 10 using devices 25 and 37, the apparatus can be adjusted to fit any user.

The adjustable connecting devices 25, 37 are substantially identical to one another. Accordingly, a description of the upper adjustable connecting device 25 will be sufficient here, with the understanding that the lower adjustable connecting device 37 is substantially identical.

Referring to FIG. 3, the upper adjustable connecting device 25 includes an outer tubing portion 40, with dimensions and characteristics corresponding to the other tubing components of the engaging arm section 20. Each of the adjustable connecting devices 25, 37 further includes an inner tubing portion 41 that fits telescopically inside, and extends coaxially within the outer tubing portion 40. Each of the adjustable connecting devices 25, 37 still further includes a threaded bolt 42 that extends coaxially through the inner tubing portion 41, and a handle 43, which has female threads formed in a shaft portion thereof, for screwing onto the threaded end of the bolt 42. Washers 44 are also provided at appropriate locations in the adjustable connecting devices 25, 37, as shown.

In using either of the adjustable connecting devices 25, 37, the handle 43 is rotated counterclockwise to loosen the engagement of several components of the device, after which the orientation of the engagement arm section 20 maybe adjusted by rotating the outer tubing portion 40 relative to the inner tubing portion 41 and bolt 42. Once a desired orientation is selected, the handle 43 is rotated clockwise, and tightened down to lock all of the components in tight engagement with each other, and to fix the orientation of the engagement arm section 20. Other locking, pivoting mechanisms could be used besides that shown in the drawings.

The engagement member 21 includes a main body 50 including a soft rest pad 52 (FIG. 6) for contacting a dorsal portion of a user 60. The rest pad 52 is preferably formed of a flexible, resilient material. Examples of materials suitable for use in forming the rest pad 52 include felt, a foamed polymer, a foamed polymer with a fabric or other flexible cover, a hollow elastomeric member, or the like. Optionally, the main body 50 of the engagement member 21 may also include a backing plate 53 to provide strength and reinforcement to the rest pad 52. The engagement member 21 also includes a threaded coupling member 51, attached to the main body 50, for threadably connecting the engagement member to the adjustment assembly 22. Such construction of the engagement member positively functions to notify the user of proper head-to-body alignment, through minimal yet noticeable contact with the user's body, in a manner which does not significantly interfere with the user's swinging motion.

Figure 7:
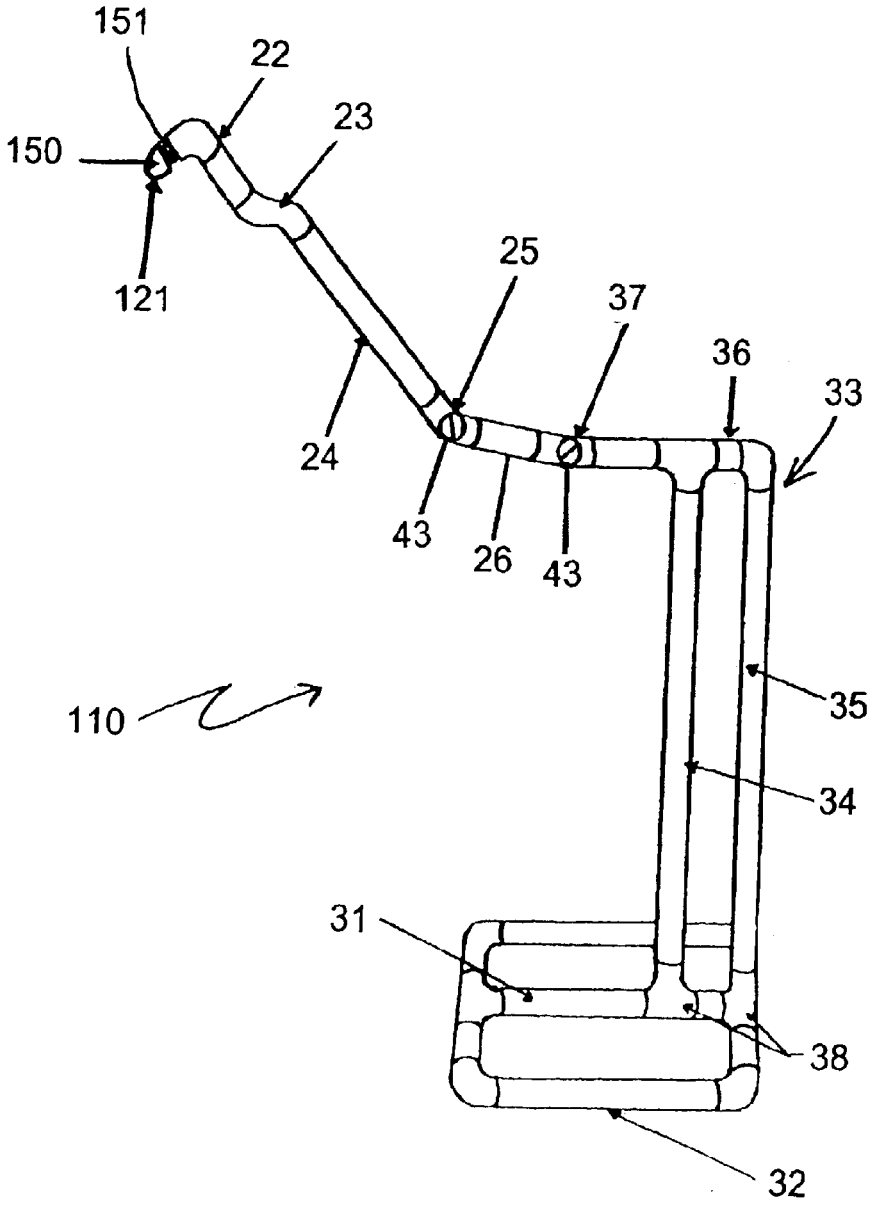
FIG. 7 is a side perspective view of a modified golf swing training apparatus, including an engagement member according to a second embodiment of the invention.

Additional changes may be made to the engagement member 21 while still achieving an appropriate engagement function according to the invention. For example, with reference to FIG. 7, a second embodiment of an engagement member 121 according to the invention is shown. With the exception of the engagement member 121, all other aspects and constituent parts of the apparatus 110 of FIG. 7 are the same as those previously described in connection with the first embodiment 10. The engagement member 121 of the second embodiment is smaller and simpler in structure than the member 21 of the first embodiment. Specifically, the member 121 includes a substantially semi-spherical, soft main body 150 formed of resiliently flexible material(s) as discussed above in connection with the pad 52, and a threaded, tubular coupling member 151 which connects to the assembly 22. As with the first embodiment of the engaging member 21, the projecting length of the member 121 relative to the fore and aft adjustment assembly 22 may be simply adjusted (longer or shorter) by rotating the member 121 at the threaded coupling 151.

In FIG. 4, the golf swing apparatus 10 is shown in the folded position thereof. In order to fold the apparatus 10 into the position shown in the drawing, both of the lower adjustable connecting devices 25, 37 are loosened as described above. Then, one of the shorter extension arms 26 is rotated downwardly toward the first vertically extending elongate stabilizing member 34. The longer extension arm segment 24, with its attached components, is situated pointing down toward the central cross member 31 of the base 32, as shown. The connecting devices 25, 37 may then be tightened to temporarily and disengagably fix the apparatus in is folded position.

Figure 5:
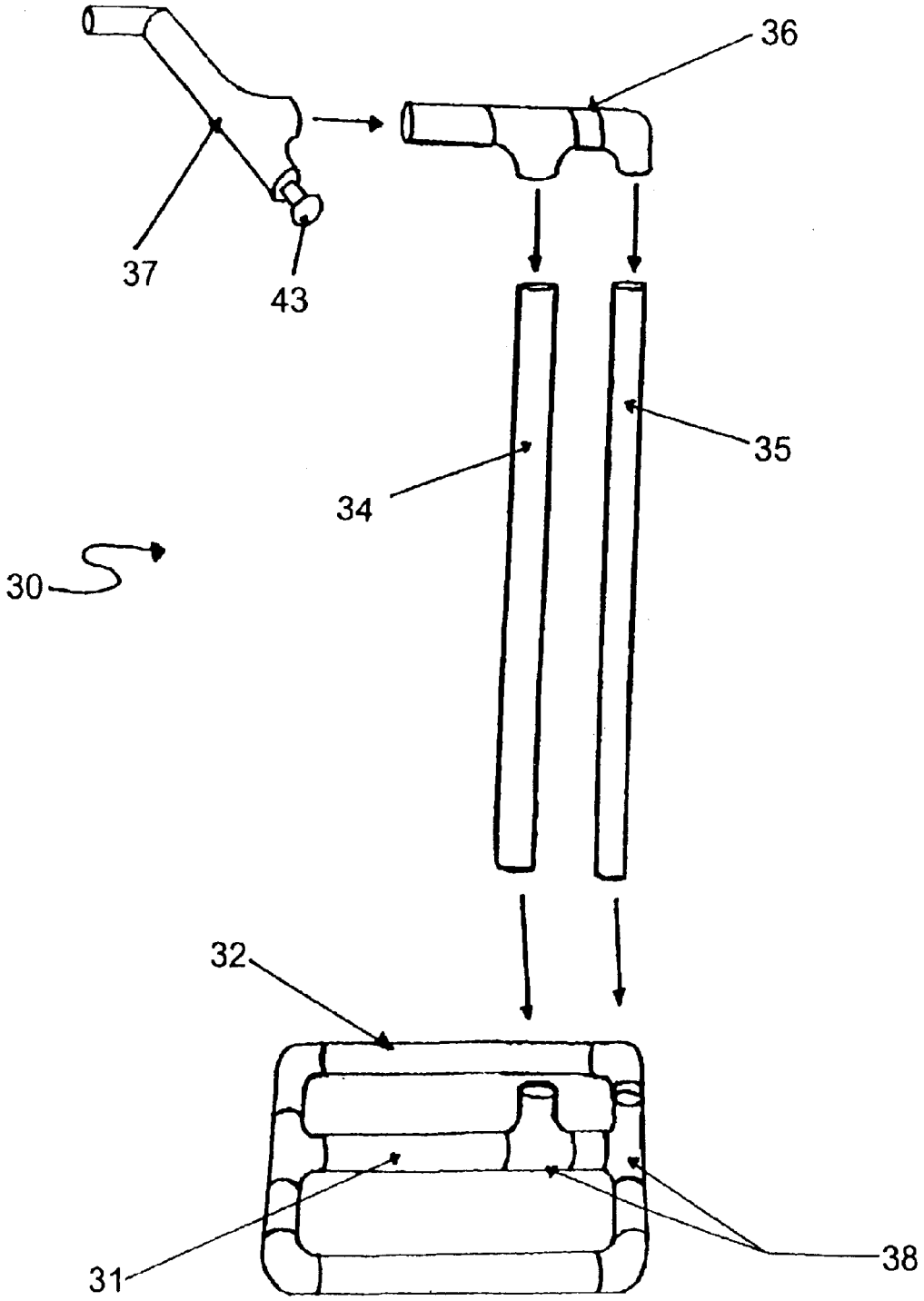
FIG. 5 is an exploded view of a support stand section of the apparatus of FIG. 1.

In FIG. 5, the support stand section 30, and the first few components of the engagement arm section 20, are shown in an exploded side perspective view to illustrate the several components thereof.

Figure 6:
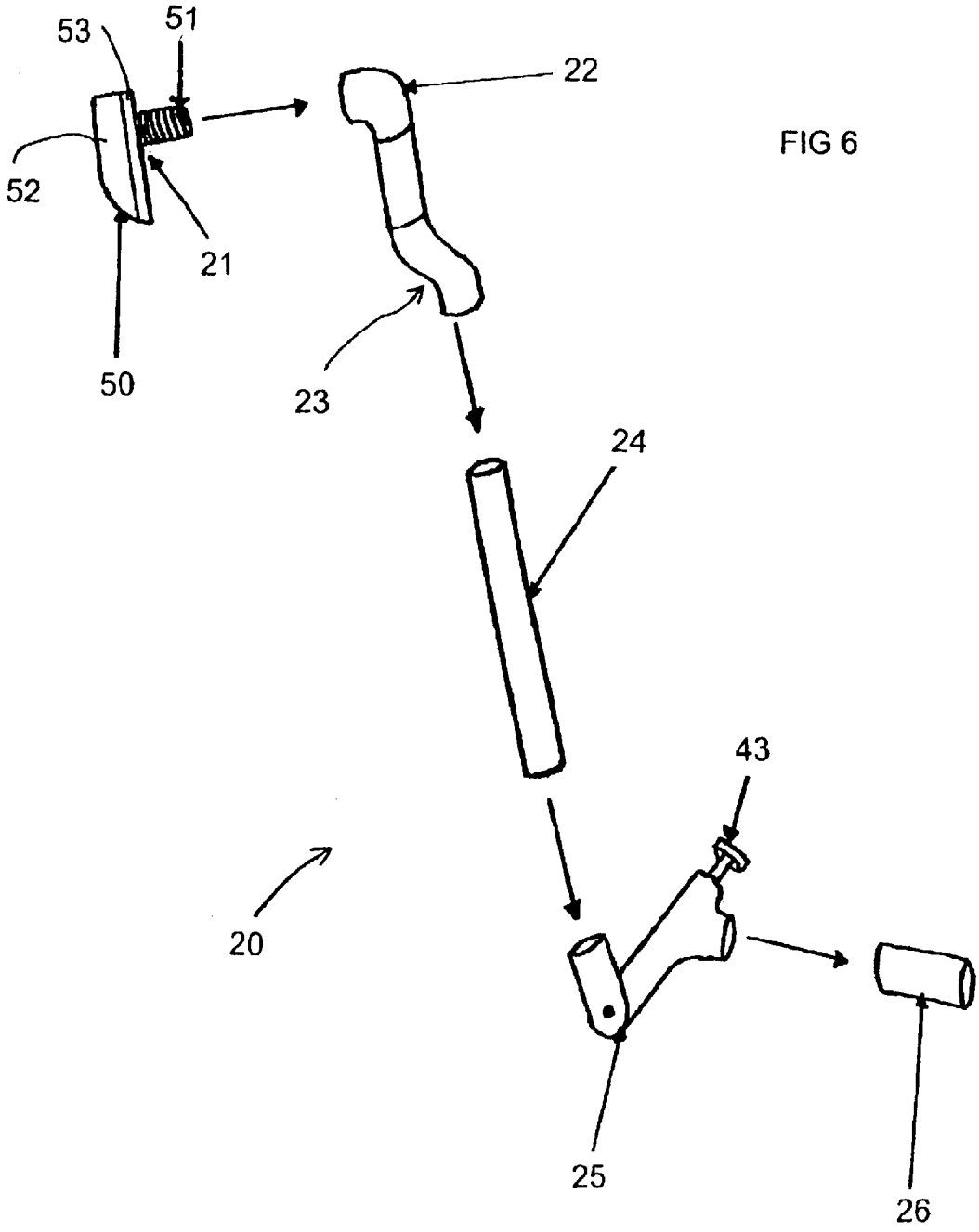
FIG. 6 is an exploded view of an adjustable engaging arm section of the apparatus of FIG. 1.

In FIG. 6, the remaining components of the engagement arm section 20 are similarly shown in an exploded side perspective view to illustrate the several components thereof.

Use of the Golf Swing Training Apparatus

With reference to FIG. 1, a golfer 60 uses the golf swing training apparatus 10 by disposing it in an appropriate location, e.g., at a driving range, with the base 32 resting on a flat surface, and the apparatus placed in its open and operative configuration, as shown. If used, the optional securing stakes are also secured about the base into the ground. The user then adjusts the orientation of the engaging arm section 20 according to the user's height and other preferences, if any, using the adjustable connecting devices 25 and 37. If desired, a second person may assist with these adjustments of the apparatus. With these few manipulations the apparatus 10 is ready to use. As depicted, the apparatus 10 is disposed substantially entirely and directly behind user during use, with the engagement member 21 lightly contacting the back of the user's neck. In this orientation, the golfer's golf club will not contact with the apparatus 10 during the golfer's swing, and the apparatus 10 is substantially entirely out of the user's field of vision, will not even be seen by the golfer 60 in his/her peripheral vision. Correspondingly, the apparatus 10 will not distract the user from his/her swinging motion, or will only minimally distract the user, due to the slight contact with the engagement member 21.

Specifically, through the slight contact of the engagement member 21 on the back of the user's neck, the golfer 60 is allowed to simply position his/her head at the same position for each swing, and to maintain that same position throughout each entire swing. With practice, using the apparatus 10 over a short period of time, the user trains his/her body and muscles to follow the same, correct position and pattern more consistently with every golf swing. The user can then implement the improved swing into his/her golf game without use of the apparatus 10.

When the apparatus 10 is not being used, it can be readily manipulated into a folded or collapsed position as shown in FIG. 4, or even disassembled into separate components as shown in FIGS. 5–6, for easy storage and transport thereof.

The relatively small size of the base 32 allows the apparatus hererof to be used on substantially any flat surface, either indoors or outdoors.

Since the engagement arm section 20 extends outwardly beyond the forward edge of the base 32, when using the apparatus, a golfer stands forward of, and spaced apart from the base, and there is only a single area of contact between the user and the apparatus 10. This single area of contact is provided by the engagement member 21.

Although the present invention has been described herein with respect to preferred embodiments thereof, the foregoing description is intended to be illustrative, and not restrictive. Those skilled in the art will realize that many modifications and variations of the preferred embodiments may be made without departing from the gist, essence or spirit of the invention. The scope of the invention is indicated by the appended claims. For example, the apparatus could include a pair of the engagement arm sections 20, or could replace the base 32 of the support stand section 30 with a large stake for being inserted into the ground.

I claim:

1. A golf swing training apparatus, comprising:

a support section comprising a base, said base comprising a plurality of operatively interconnected tubular components; and an adjustable engagement arm extending from said support section and having a free end comprising an engagement member, said engagement arm being pivotally attached to said support section and being adjustable about a substantially horizontal axis, whereby said apparatus may be placed into either an operative configuration or a folded configuration;

said engagement member provided for contacting a single, limited area of a dorsal surface of a golfer's body throughout a club swinging motion of the golfer;

said apparatus adapted to be substantially out of a field of vision of the golfer when the apparatus is in use;

wherein said free end of said engagement arm extends beyond said base in said operative configuration thereof, such that a user of the apparatus is able to stand forward of and spaced apart from the base when in contact with said engagement member;

whereby during use, the only area of contact between the apparatus and a user is provided by said engagement member.

2. The training apparatus of claim 1, wherein the adjustable engagement arm includes at least one pivotal, releasably lockable connecting device.

3. The training apparatus of claim 2, wherein said connecting device comprises a first tube and a second tube which fits coaxially within the first tube.

4. The training apparatus of claim 2, wherein the adjustable engagement arm includes two pivotal, releasably lockable connecting devices.

5. The training apparatus of claim 4, wherein said adjustable engagement arm is adjustable between a collapsed, storage position and a range of operative positions.

6. The training apparatus of claim 1, wherein said engagement member comprises a pad formed from a flexible material.

7. The training apparatus of claim 6, wherein said engagement member comprises a backing plate for supporting said pad.

8. The training apparatus of claim 1, wherein said adjustable engagement arm and said support stand each include multiple tubular components.

9. The training apparatus of claim 1, wherein said engagement member is adjustably connected to said adjustable engagement arm such that a projecting distance of the engagement member relative to said adjustable engagement arm is variable.

10. The training apparatus of claim 9, wherein said engagement member is threadably engaged in an end portion of said engagement arm, and is rotatably adjustable thereon.

11. The training apparatus of claim 1, wherein said engagement member includes a rounded surface for contacting a dorsal portion of a user's body.

12. A method of using a golf swing aid of claim 1, the method comprising the steps of:

a) placing the golf swing aid on a flat substantially surface;

b) positioning an adjustable engagement arm of the golf swing aid such that a contact pad of an engagement member on the adjustable engagement arm is reaching outwardly beyond said base for contacting a dorsal surface of the user, said contact pad providing a single contact area for contacting the user;

c) standing in front of the golf swing aid and touching a selected dorsal part of the user against the contact pad while spaced away from said base; and d) swinging a golf club while maintaining contact between the contact pad and the selected dorsal part of the user.

13. The training apparatus of claim 1, wherein said apparatus is adapted to allow a user to practice swinging while standing on a selected natural which is separate from said apparatus, said natural surface being substantially representative of a surface encountered during actual playing conditions.

14. A golf swing training apparatus, comprising:

a support section comprising:

a base, a substantially vertical support attached to the base, and a substantially horizontal upper bridge member attached to the vertical support; and an adjustable engagement arm pivotally attached to said upper bridge member and having a free end comprising an engagement member, said engagement arm comprising first and second extension arm segments and at least one pivotal connecting device interconnecting the first and second extension arm segments and permitting movement of the second extension arm segment about a substantially horizontal axis relative to the first extension arm segment;

said engagement member being provided for contacting a dorsal surface of a golfer's body throughout a club swinging motion of the golfer;

wherein said free end of said engagement arm extends beyond said base, such that a user of the apparatus is able to stand forward of and spaced apart from the base when in contact with said engagement member.

15. The training apparatus of claim 14, wherein said adjustable engagement arm and said support stand each include multiple tubular components.

16. The training apparatus of claim 14, wherein said engagement member is adjustably connected to said adjustable engagement arm such that a projecting distance of the engagement member relative to said adjustable engagement arm is variable.

17. The training apparatus of claim 14, wherein the base comprises a plurality of operatively interconnected tubular components, and wherein the base has openings formed therein between some of said tubular components.

18. The training apparatus of claim 17, wherein said apparatus is placeable into a folded configuration in which one of said extension arm segments is oriented at an acute angle with respect to said upper bridge member.

19. A golf swing training apparatus, comprising:

a support section comprising a base, said base comprising a plurality of operatively interconnected tubular components; and an adjustable engagement arm extending from said support section and having a free end comprising an engagement member, said engagement arm comprising first and second extension arm segments and at least one pivotal connecting device interconnecting the first and second extension arm segments and permitting movement of the second extension arm segment about a substantially horizontal axis relative to the first extension arm segment;

said engagement member provided for contacting a dorsal surface of a golfer's body throughout a club swinging motion of the golfer;

wherein said apparatus is adapted to provide a single limited area of contact between the golfer and the apparatus during use thereof, said single limited contact area comprising a surface of said engagement member.

20. The apparatus of claim 19, wherein the base of said support section comprises a plurality of operatively interconnected tubular components.

21. The apparatus of claim 19, wherein the base of said support section is narrower than the length of a golf club shaft, and wherein said apparatus is adjustable between a compact, folded storage position and a range of operative positions.

* * * * *